United States Patent [19]

Hosking

[11] Patent Number: 4,610,567

[45] Date of Patent: Sep. 9, 1986

[54] TRENCH COMPACTION DEVICE

[76] Inventor: Raymond E. Hosking, 4331 S. Arbutus Way, Morrison, Colo. 80465

[21] Appl. No.: 631,910

[22] Filed: Jul. 18, 1984

[51] Int. Cl.[4] ..... E01C 19/26

[52] U.S. Cl. ..... 404/121; 404/123; 404/127; 404/128; 404/129; 404/132; 172/548; 172/547

[58] Field of Search ..... 404/121, 123, 124, 127–129, 404/132; 172/547, 548, 606–610

[56] References Cited

U.S. PATENT DOCUMENTS

| | | | |
|---|---|---|---|
| 1,624,734 | 4/1927 | Hunt | 404/121 |
| 1,668,142 | 5/1928 | Conger | 404/129 X |
| 1,802,556 | 4/1931 | Hendricks | 404/129 X |
| 2,146,101 | 2/1939 | Weber | 404/121 |
| 2,176,984 | 10/1939 | Adkinson | 172/548 |
| 2,891,335 | 6/1959 | Linneman | 404/127 X |
| 3,318,209 | 5/1967 | Schultz | 404/121 |
| 3,595,411 | 7/1971 | Ables | 404/121 X |
| 3,891,342 | 6/1975 | Roe | 404/121 X |
| 4,260,281 | 4/1981 | Sargent | 404/127 |
| 4,269,535 | 5/1981 | Schultz | 404/121 X |
| 4,278,368 | 7/1981 | Livesay | 404/117 |

*Primary Examiner*—James A. Leppink
*Assistant Examiner*—John F. Letchford
*Attorney, Agent, or Firm*—Edwin H. Crabtree

[57] ABSTRACT

A trench compaction device adapted for mounting on construction and excavation type equipment. The device having a sheepsfoot open-rim wheel design which is static rather than vibratory and uses the down pressure of the equipment to achieve standard density compaction requirements.

4 Claims, 4 Drawing Figures

TRENCH COMPACTION DEVICE

BACKGROUND OF THE INVENTION

This invention relates to a compaction device and more particularly but not by way of limitation to a trench compaction device adapted for mounting on construction type equipment for compacting fill dirt in trenches and other soil compaction requirements.

Heretofore, there have been various types of compaction wheels, sheepsfoot rollers, vibratory rollers and drums for compacting fill dirt. To eliminate dirt build-up around the compaction wheel and frame, cleaning bars have been mounted on the compaction wheel frames. These cleaning bars quite often would bend, break and would be ineffective in cleaning dirt from around the sides of the compaction wheel.

Also, prior art sheepsfoot rollers and vibratory compaction devices compacted dirt from the top of the ditch downwardly which causes a bridging effect without uniform compaction of the dirt. Also, this type of compaction does not provide for compacting the dirt from the bottom of the ditch upwardly.

In the following United States patents, U.S. Pat. No. 2,146,101 to Weber, U.S. Pat. No. 2,891,335 to Linneman, U.S. Pat. No. 3,595,411 to Ables, U.S. Pat. No. 3,891,342 to Roe and U.S. Pat. No. 4,278,368 to Livesay various types of sheepsfoot compactors and roller attachments are shown for attachment to a compaction type equipment. None of these prior art devices particularly point out the unique features and advantages of the subject trench compaction device as described herein.

SUMMARY OF THE INVENTION

The subject invention provides a plurality of open-rim compaction wheels having sheepsfoot tips mounted thereon with the frame disposed between the wheels to act as a means for self-cleaning the dirt collected between the wheels as the wheels are rotated on the frame.

The invention eliminates the use of cleaning bars, cleaning teeth and similar types of devices used for cleaning of dirt in and around the compaction wheels. Because the frame is disposed between the compaction wheels, compaction can be made adjacent the sides of a trench.

The trench compaction device eliminates the bridging effect in trench compaction. The device is static in nature and does not use vibration thereby eliminating common maintenance problems related to vibratory compactors.

The compaction device compacts dirt from the bottom of the ditch upwardly allowing production to be increased by 20 to 40 percent with uniform compaction for required soil density. Also, the device self-levels dirt in the trench eliminating having to level the dirt in the ditch prior to compaction.

The sheepsfoot tips on the compaction wheels are staggered for better compaction with the wheels having an opened spoke design allowing the dirt to escape as the dirt is compacted from the bottom upwardly in the ditch.

The trench compaction device is adapted ior mounting on construction type equipment and includes a mounting bracket having a removable stabilizer or wings attached thereto. At least one frame is attached at one end to the bracket. The other end of the frame includes an axle rotatably mounted thereon. A first compaction wheel and a second compaction wheel are mounted on the opposite ends of the axle with the frame disposed therebetween. The frame supports the wheels and acts to clean and remove dirt fill as the wheels are rotated thereon.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
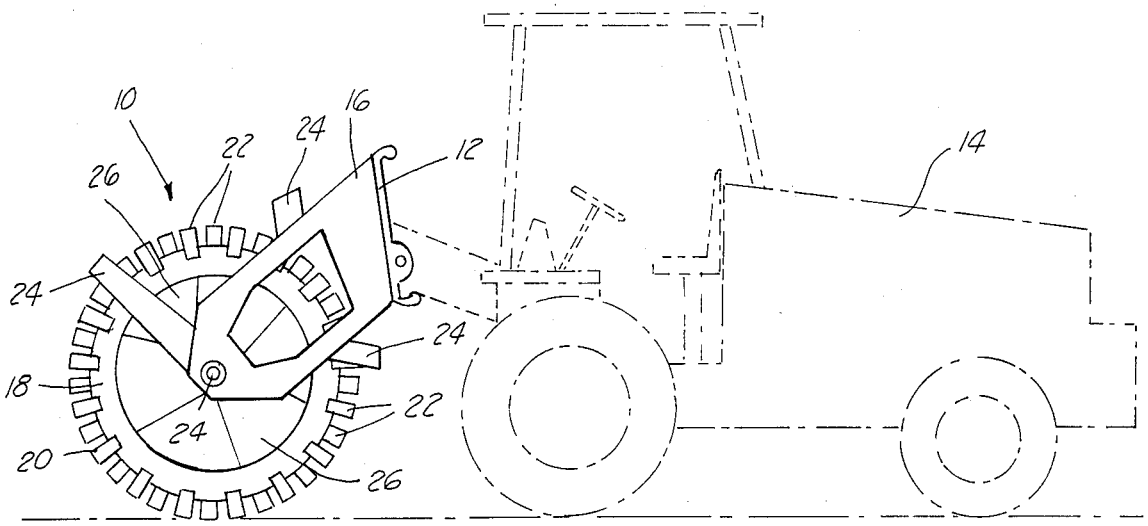
FIG. 1 PRIOR ART
FIG. 1 illustrates a prior art trench compaction device mounted on a piece of construction type equipment.

In FIG. 1 a prior art trench compaction wheel is shown and designated by general reference numeral 10. The device 10 includes a mounting bracket 12 which is adapted for quick disconnect from a piece of construction equipment 14 shown in dotted lines. Attached to the mounting bracket 12 is a frame 16 which is received on opposite sides of a plurality of compaction wheels 18 and 20 having sheepsfoot tips 22 mounted therearound. The frame 16 as mentioned is received on opposite sides of the wheels and is rotatably attached to the wheels by an axle 24. To remove the collection of dirt and other materials which are lodged between the wheels, cleaning bars 24 are attached to the frame 16 and disposed adjacent the outer diameter of the wheels 18 and 20. While the cleaning bars 24 are effective in removing dirt from outside the pheriphery of the wheels 18 and 20 nothing is provided for eliminating dirt build up as it is received adjacent the sides of the inner diameter of the wheels. It has been found that providing an open-rim design of the wheels 18 and 20 having openings 26 therein helps alleviate the build-up of dirt, but in heavy soil conditions such as clay-like material or during muddy conditions, the open-rim design does little to alleviate the build-up of dirt and mud between the wheels.

Figure 2:
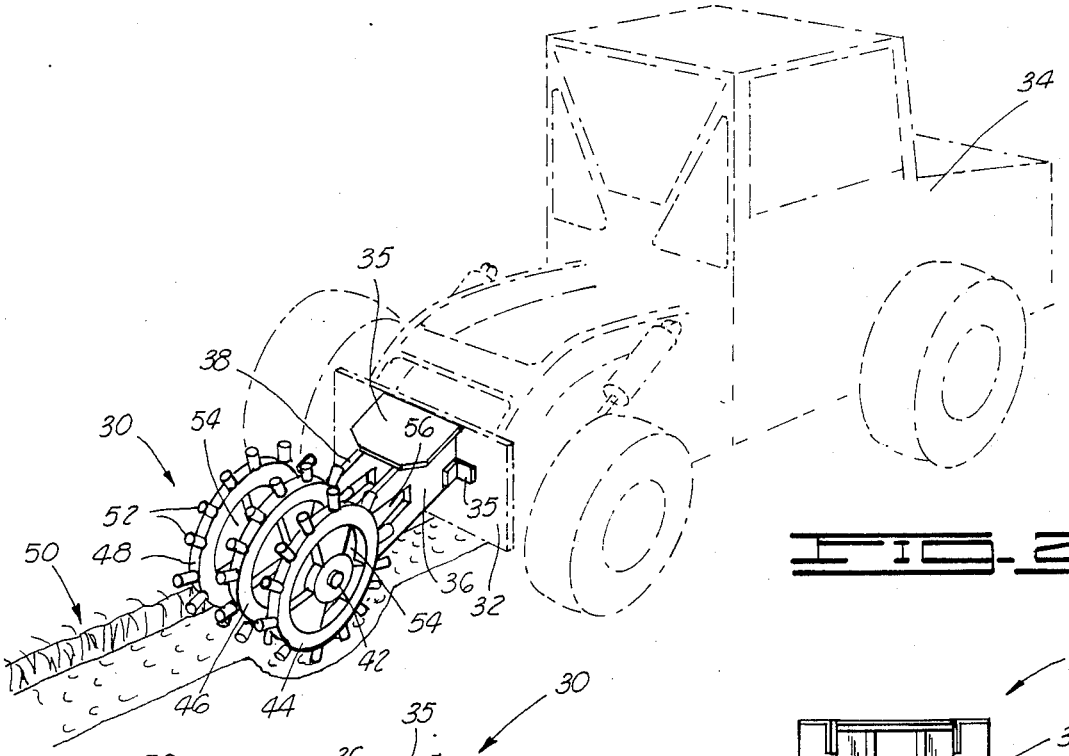
FIG. 2 illustrates the subject trench compaction device mounted on a piece of construction type equipment.
Figure 4:
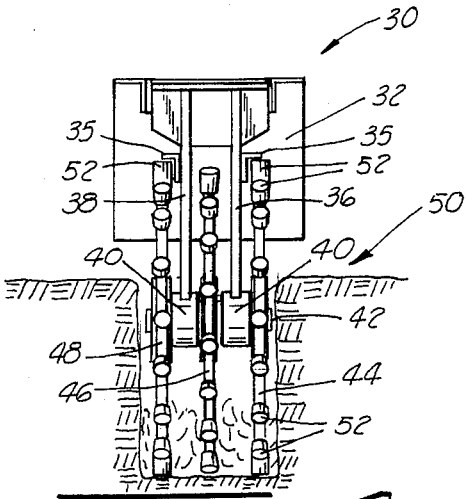
FIG. 4 illustrates a front view of the trench compaction device.

In FIG. 2 the subject trench compaction device for improved dirt compaction in trenches and the like is shown and designated by general reference numeral 30. The device 30 uses static pressure with no vibration to achieve improved compaction to meet standard soil density requirements. The device 30 includes a mounting bracket 32 adapted for quick disconnect to a piece of construction or excavating equipment 34 shown in dotted lines. The mounting bracket 32 may include removable support stabilizers 35 or wing supports for securing one end of a first frame 36 and a second frame 38 to the bracket 32. The other end of the frames 36 and 38 are attached to pillow block bearings 40 which are shown in FIG. 4 for receiving an axle 42 rotatably mounted thereon.

A first compacting wheel 44, a second compaction wheel 46 and a third compaction wheel 48 are shown attached to the axle 42 in FIG. 2 with the second wheel 46 disposed between the first and second frame 38 and 38. The first wheel 44 and third wheel 48 are mounted on opposite ends of the axle 42 with the first and second frame 36 and 38 received therebetween.

The first and second frames 36 and 38 are not only used to support and rotatably mount the compaction wheels thereon, but the frames also act to remove the collection and build-up of dirt received therebetween as the device 30 compacts dirt in ditch designated by general reference numeral 50. While the ditch 50 is shown it can be appreciated that the device 30 can be used equally well for various types of soil and dirt compaction applications.

The outer periphery of the wheels 44, 46 and 48 receive sheepsfoot tips 52 attached thereto and evenly spaced around the circumference. The wheels 44, 46 and 48 also include openings 54 therearound for providing an open rim design to aid in allowing the dirt to escape as the dirt is compacted from the bottom upwardly in the ditch 50.

Figure 3:
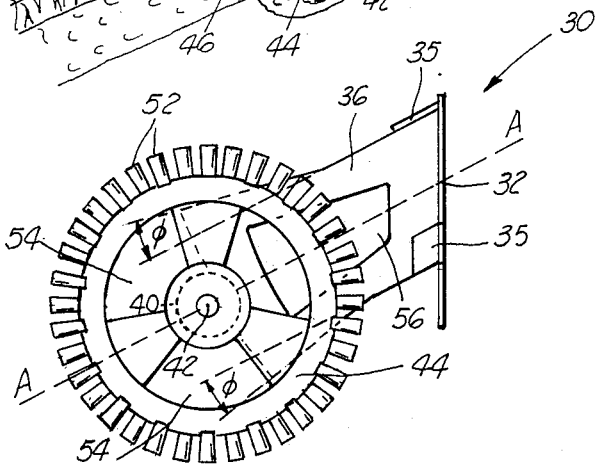
FIG. 3 is a side view of the trench compaction device.

In FIG. 3 a side view of the trench compaction device 30 can be seen. In this FIG. the adjacent sheepsfoot tips 52 can be seen staggered and offset from the sheepsfoot teeth of the adjacent wheel so there is continuous contact of the tips 52 with the dirt as the wheels are rotated in the ditch 50.

Also, the opposite ends of the frame 36 and 38 are tapered upwardly from a line parallel to a center line A—A along the length of the frame and through the center of the axle 42. The frame is angled upwardly by 5 to 20 degrees and designated by character $\Phi$. By providing the angle $\Phi$ on the frame, a better angle of attack on the end of the frame is provided in removing dirt and mud build-up between the wheels as the wheels are rotated either in a clockwise or counter clockwise direction. From reviewing FIG. 3 it can be seen the end of the frame 36 is angled both upwardly and downwardly by the angle $\Phi$ to provide the feature of better dirt removal.

It can also be seen in FIG. 3 that the frames 36 and 38 have an opening 56 therethrough for allowing the dirt to escape from in and around the frames as the wheels compact the dirt in the ditch 50.

In FIG. 4 a front view of the device 30 can be seen received in the ditch 50. By allowing the frames 36 and 38 to be positioned between the wheels 44, 46 and 48 with the first and third wheels 44 and 48 attached to the ends of the axle 42, the device 30 provides for improved compaction adjacent the sides of the ditch 50.

Because of the improved static compaction using the device 30, the device allows for increased amounts of fill for compacting from the bottom of the ditch 50 upward with increased production of 20 to 40 percent with uniform soil compaction density. While three compaction wheels are shown the device 30 works equally well with a single frame and two compaction wheels for narrow ditch applications. Further, ior larger applications four or more wheels could be used with the necessary frames mounted between and supporting the wheels.

Through the unique features of having the compaction wheels disposed on opposite sides of the support frames, the device 30 cleans and removes dirt build-up more efficiently than prior art compaction wheels. Also the device provides for improved compaction and dirt penetration for overall increased production in the compaction of dirt in trenches and other soil compaction operations.

Changes may be made in the construction and arrangement of the parts or elements of the embodiments as described herein without departing from the spirit or scope of the invention defined in the following claims.

What is claimed is:

1. A trench compaction device adapted for mounting on construction type equipment and the like, the compaction device comprising:

a mounting bracket used for quick-disconnect of the attachment of the compaction device to the equipment;

a first frame having a first end and a second end, the first end attached to the bracket;

a second frame having a first end and a second end, the first end attached to the bracket, the second frame parallel to the first frame;

an axle rotatably mounted on the second ends of the first and second frames, the frames having a centerline along their length and through the center of the axle;

a first compaction wheel, a second compaction wheel and a third compaction wheel, the wheels rotatably mounted on the axle, the first and third compaction wheels mounted on opposite ends of the axle with the second compaction wheel disposed between the first and second frames, the first frame and the second frame having an upper edge and lower edge along the length thereof, the upper edge and lower edge extending outwardly from the bracket and parallel to the centerline of the frame, the upper edge as it approaches an area adjacent an outer periphery of the wheels extending upwardly at an angle $\phi$ and continuing at this angle to the second end of the frame, the lower edge extending outwardly from the bracket and parallel to the centerline of the frame, the lower edge, as it approaches an area adjacent an outer periphery of the wheels, extending downwardly at an angle $\phi$ and continuing at this angle to the second end of the frame, the first and second frames supporting the wheels with the edges of the frames acting to clean and remove fill dirt as the wheels are rotated thereon.

2. The device as described in claim 1 wherein the angle $\phi$ is in a range of 5 to 20 degrees.

3. A trench compaction device adapted for mounting on construction type equipment and the like, the compaction device comprising:

a mounting bracket used for quick-disconnect of the attachment of the device to the equipment;

a first frame having a first end and a second end, the first end attached to the bracket;

an axle rotatably mounted on the second end of the frame, the frame having a centerline along its length and through the center of the axle;

a first compaction wheel and a second compaction wheel mounted on opposite ends of the axle, the first frame disposed between the wheels, the first frame having an upper edge and lower edge along the length thereof, the upper edge extending outwardly from the bracket and parallel to the centerline of the frame, the upper edge as it approaches an area adjacent an outer periphery of the wheels extending upwardly at an angle $\phi$ and continuing at this angle to the second end of the frame, the first frame supporting the wheels with the edges of the frame acting to clean and remove fill dirt as the wheels are rotated thereon.

4. A trench compaction device adapted for mounting on construction type equipment and the like, the compaction device comprising:

a mounting bracket used for quick-disconnect of the attachment of the compaction device to the equipment;

a first frame having a first end and a second end, the first end attached to the bracket;

an axle rotatably mounted on the second end of the frame, the frame having a centerline along its length and through the center of the axle;

a first compaction wheel and a second compaction wheel mounted on opposite ends of the axle, the first frame disposed between wheels, the first frame having an upper edge and a lower edge along the length thereof, the lower edge extending outwardly from the bracket and parallel to the centerline of the frame, the lower edge, as it approaches an area adjacent an outer periphery of the wheels extending downwardly at an angle $\phi$ and continuing at this angle to the second end of the frame, the first frame supporting the wheels with the edges of the frame acting to clean and remove fill dirt as the wheels are rotated thereon.

* * * * *